US005803880A

United States Patent [19]

Allen

[11] Patent Number: 5,803,880

[45] Date of Patent: Sep. 8, 1998

[54] STEPPER/CLIMBER EXERCISER

[76] Inventor: Temple W. Allen, 13631 Stoney Hill, San Antonio, Tex. 78231

[21] Appl. No.: 571,119

[22] Filed: Dec. 12, 1995

[51] Int. Cl.[6] ..... A63B 21/008; A63B 23/04

[52] U.S. Cl. ..... 482/113; 482/53; 482/37

[58] Field of Search ..... 482/51, 52, 53, 482/111, 112, 37, 113, 34, 7; 601/27, 34, 35

[56] References Cited

U.S. PATENT DOCUMENTS

| | | | |
|---|---|---|---|
| 4,848,737 | 7/1989 | Ehrenfield | 272/70 |
| 4,923,191 | 5/1990 | Persico | 272/69 |
| 4,958,830 | 9/1990 | Huggins et al. | 272/69 |
| 5,000,441 | 3/1991 | Wang | 272/70 |
| 5,040,785 | 8/1991 | Charnitski | 272/70 |
| 5,114,389 | 5/1992 | Brentham | 482/53 |
| 5,145,475 | 9/1992 | Cares | 482/52 |
| 5,169,361 | 12/1992 | Hsu | 482/53 |
| 5,183,449 | 2/1993 | De Cloux | 482/53 |
| 5,207,621 | 5/1993 | Koch et al. | 482/53 |
| 5,222,927 | 6/1993 | Chang | 482/53 |
| 5,256,117 | 10/1993 | Potts et al. | 482/52 |
| 5,318,490 | 6/1994 | Henderson et al. | 482/53 |
| 5,328,422 | 7/1994 | Nichols | 482/52 |
| 5,330,397 | 7/1994 | Prince et al. | 482/113 |
| 5,370,592 | 12/1994 | Wu | 482/53 |
| 5,378,209 | 1/1995 | Kendrew | 482/52 |
| 5,397,287 | 3/1995 | Lindfors | 482/113 |
| 5,437,587 | 8/1995 | Prince et al. | 482/113 |
| 5,490,818 | 2/1996 | Haber et al. | 482/51 |
| 5,527,251 | 6/1996 | Davis | 482/113 |

*Primary Examiner*—Stephen R. Crow
*Attorney, Agent, or Firm*—Millen, White, Zelano & Branigan, P.C.

[57] ABSTRACT

A stepper/climber machine includes a frame supported on a base with the frame being comprised of first and second hollow columns connected to a hollow cross-beam. Within the first and second hollow columns, there are first and second rigid struts, respectively. Each of the rigid struts has a foot pedal and handgrip fixed thereto. The rigid struts are connected by a cable which is trained through the hollow cross-beam so that as one strut moves upwardly, the other strut moves downwardly, thereby raising one handgrip and pedal while allowing the other handgrip and pedal to lower. The first and second struts are connected to one another through a hydraulic circuit which includes a branched portion with legs having opposed one-way check valves in series with solenoid valves. A selector determines the lengths of the strokes by opening and closing the solenoid valves alternately so that fluid can only flow in one direction through the hydraulic circuit. In this way, the person using the stepper/climber exercise machine must cycle the machine through complete strokes instead of being able to shorten the strokes as the exercise proceeds, allowing the person using the machine to optimize their workout. The hydraulic circuit also includes an adjustable valve which allows the user to increase or decrease the resistance to flow, and thus the resistance encountered during the exercise routine.

16 Claims, 5 Drawing Sheets

STEPPER/CLIMBER EXERCISER

FIELD OF THE INVENTION

The present invention relates generally to the art of machine-assisted exercise, and more particularly to an improved stepper/climber exercise machine for exercising the upper and lower body as well as the limbs.

BACKGROUND ART

Stepper exercise machines provide a simulated stair climbing exercise in which two foot-operated pedals movably mounted to a free standing supporting frame are synchronized by an appropriate mechanism. For example, the pedals may be interconnected by a cable arranged so that as one pedal rises, the other falls. Generally, the operation of the pedals is damped by a resistance element such as a hydraulic cylinder which opposes the weight of the user. As the user's weight is shifted from one pedal to the other, the effort required to climb a staircase is simulated.

Generally, climber exercise machines typically have left and right handles disposed above the head of the user, requiring the user to reach up in order to grasp the handles which are alternately pulled down to a chest level against a yielding resistance. Each handle is returned to its elevated position upon force being applied to the opposite handle. Stepper and climber exercise machines have been combined into single units so as to allow the user to receive the benefit of both exercises simultaneously.

Currently available stepper/climber exercise machines have the drawback of permitting the user to compromise his or her exercise routine by not moving their arms or legs through the distance of a full stroke with each cycle. This problem becomes increasingly apparent during later stages of the exercise routine.

Another problem with current commercial embodiments of stepper/climber exercise machines is that they are supported on a single strut, which to many users appears unstable.

SUMMARY OF THE INVENTION

In view of the aforementioned considerations, it is an object of the present invention to provide a new and improved stepper/climber exercise machine in which the length of the stroke is conveniently set to maintain a specific stroke length during an exercise routine.

In view of this object and other objects, an exercise device cycled through a series of alternating first and second strokes includes a selector for pre-selecting a length for each of the strokes. The lengths of the strokes are then controlled by preventing the strokes from changing from first strokes to second strokes and from second strokes to first strokes until the pre-selected length has been traversed, whereby a person using the device is precluded from making strokes which are less than the length of the pre-selected storkes.

In a further aspect, a stepper/climber machine comprises a base and a frame extending upwardly from the base. A first foot pedal and a first handgrip are positioned in spaced relation for movement on the frame through rising and descending strokes and a second foot pedal and a second handgrip positioned in spaced relation for movement on the frame through rising and descending strokes. A selector pre-selects a length for the strokes and a connection controls the lengths of the strokes by preventing the foot pedals and handgrips from changing from a rising stroke to a descending stroke and from a descending stroke to a rising stroke until the pre-selected length has been traversed by the foot pedals and handgrips, whereby a person using the device is precluded from making strokes which are less than the length of the pre-selected strokes.

In accordance with still another aspect, the present invention is directed to an exercise device comprising a base with a frame extending upwardly from the base. A first strut is restrained for longitudinal movement with respect to the frame and includes both a foot pedal and handgrip positioned in spaced relation thereon. A second strut is also restrained for longitudinal movement with respect to the frame and includes a second pedal and a second handgrip positioned in spaced relation thereon. The first and second struts are connected by a first connection for pulling one strut up in a rising stroke as the other strut is pushed down in a descending stroke. The length of each stroke is pre-selected by a selector. A second connection between the struts controls the length of the strokes by preventing the struts from changing from a rising stroke to a descending stroke and from a descending stroke to a rising stroke until the pre-selected stroke length has been traversed by the struts. Consequently, a person using a device is precluded from making strokes which are less than the length of the pre-selected strokes.

More specifically, the aforedescribed second connection is a fluid circuit which includes alternate paths. Each path include a check valve and "on-off" valve. The check valves are oriented in opposite directions from one another and are in series with the on-off valves wherein closing one check valve and opening the other check valve reverses the direction of fluid flow in the circuit.

In still another aspect, the aforedescribed frame comprises a pair of columns which are hollow to receive the first and second struts. The columns are connected by a hollow beam to form a continuous channel. A cable connected to the top of the struts and strung through the channel provides the aforementioned first connection which ensures that when one strut is descending, the other strut is pulled upwardly and vice-versa.

DETAILED DESCRIPTION

Figure 1:
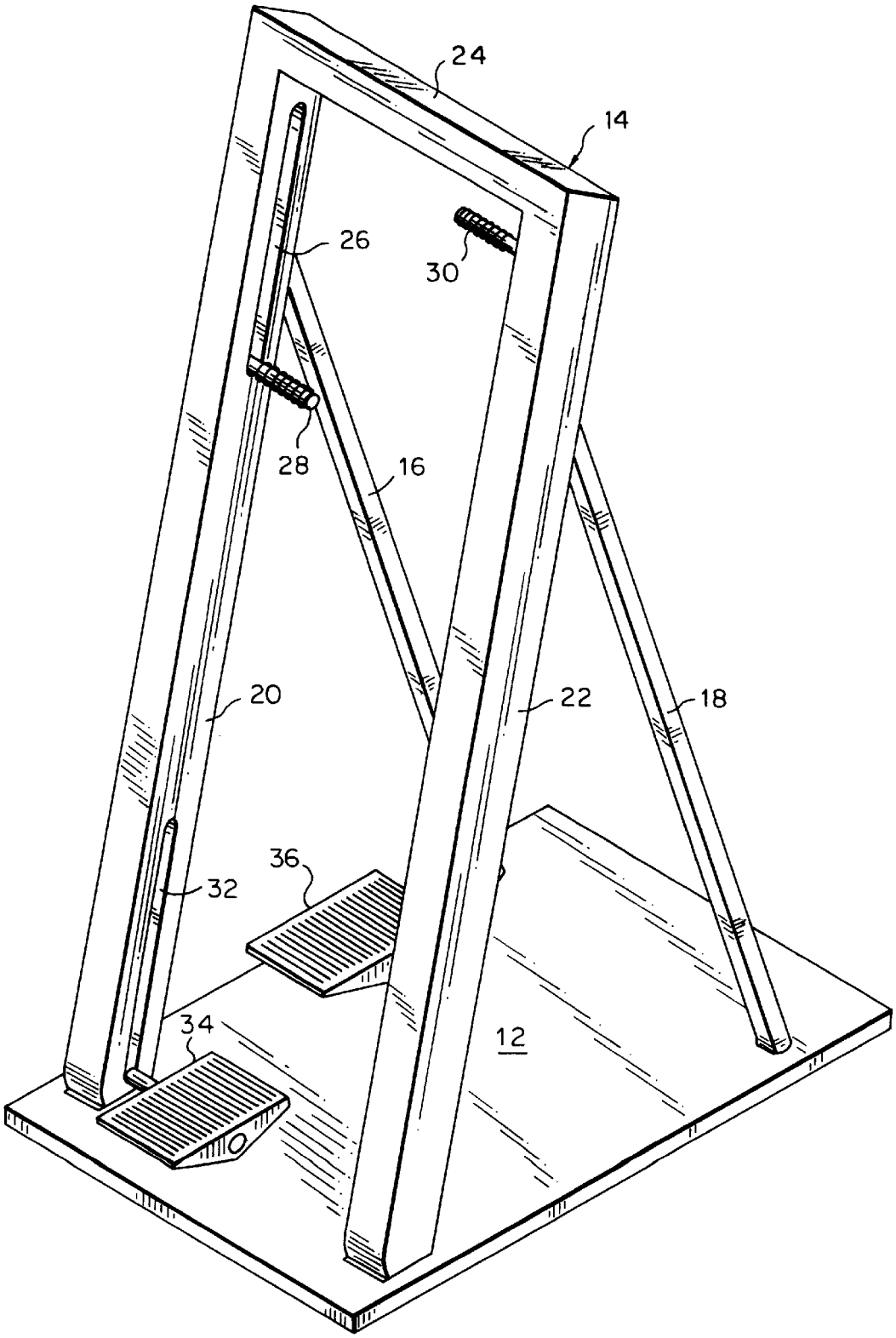
FIG. 1 is a perspective view of a stepper/climber exercise device configured in accordance with the present invention.

Referring now to FIG. 1, there is shown a stepper/climber exercise machine 10 configured in accordance with the principles of the present invention. The stepper/climber machine 10 includes a base 12 to which is pivoted a frame 14. The frame 14 is positioned at a desired angle $\alpha$ by a pair of braces 16 and 18 which are also pivoted to the base 12. The frame 14 includes a first column 20 and second column 22 joined by a hollow beam 24. Projecting through slots 26 and the hollow columns 20 and 22 are first and second handgrips 28 and 30, and projecting through slots 32 in the columns are first and second foot pedals 34 and 36. As is seen in FIG. 1 when the handle 28 is in a down mode, the foot pedal 34 is in a down mode, and when the handle 30 is in an up mode, the foot pedal 36 is in an up mode. As the machine 10 is operated, the up and down modes interchange.

Figure 2:
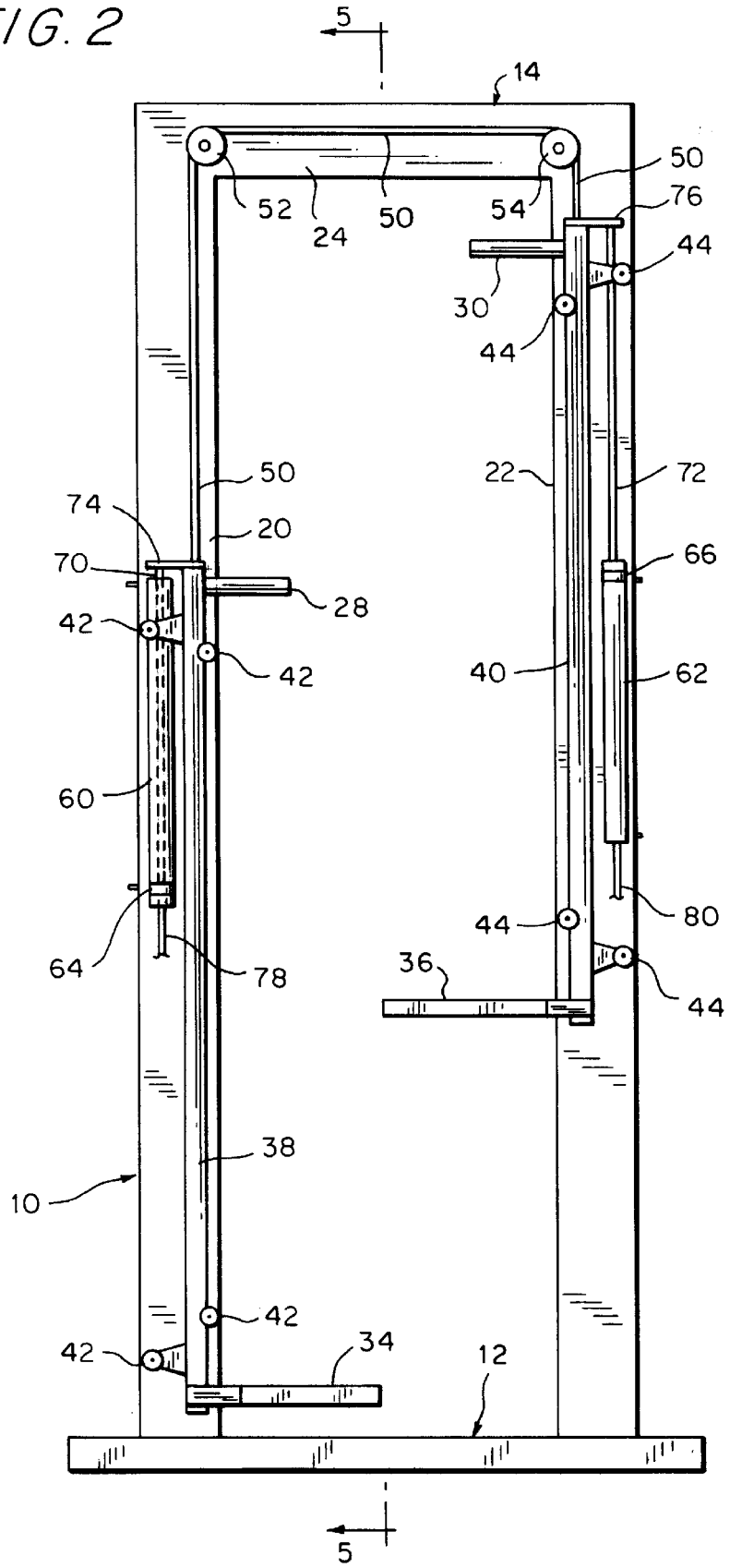
FIG. 2 is a front view of the stepper/climber exercise device of FIG. 1 with portions broken away to reveal internal structure.

Referring now to FIG. 2, where the frame 14 is shown with the front surface thereof removed to reveal the inner components, it is seen that the first handgrip 28 and first step 34 are joined by a strut 38 while the second handgrip 30 and second step 36 are joined by a strut 40. The struts 38 and 40 have wheel pairs 42 and 44, respectively which stabilize the struts within their respective columns 20 and 22 while allowing the struts to rise and fall within the columns with minimal friction. At the top of each of the struts 38 and 40, a cable 50 is connected. The cable 50 is trained around pulleys 52 and 54 aligned with the hollow beam 24

In operation, the user has its left foot on the first pedal 34 and left hand gripping the first handgrip 28. Upon applying a stepping force to the second pedal 36 and a downward pulling force to the second handgrip 30, the cable 50 will pull on the first rigid strut 38, lifting the first rigid strut 38 toward the upward position while the rigid strut 40 descends. In order to control the rate of rise and descent, first and second hydraulic cylinders 60 and 62 which are anchored to the first and second columns 38 and 40, respectively, have pistons 64 and 66 which are connected via piston rods 70 and 72 to the struts 38 and 40, respectively by couplings 74 and 76, respectively. The hydraulic cylinders 60 and 62 are connected by first and second hydraulic lines 78 and 80 to the hydraulic circuit of FIG. 3.

Figure 3:
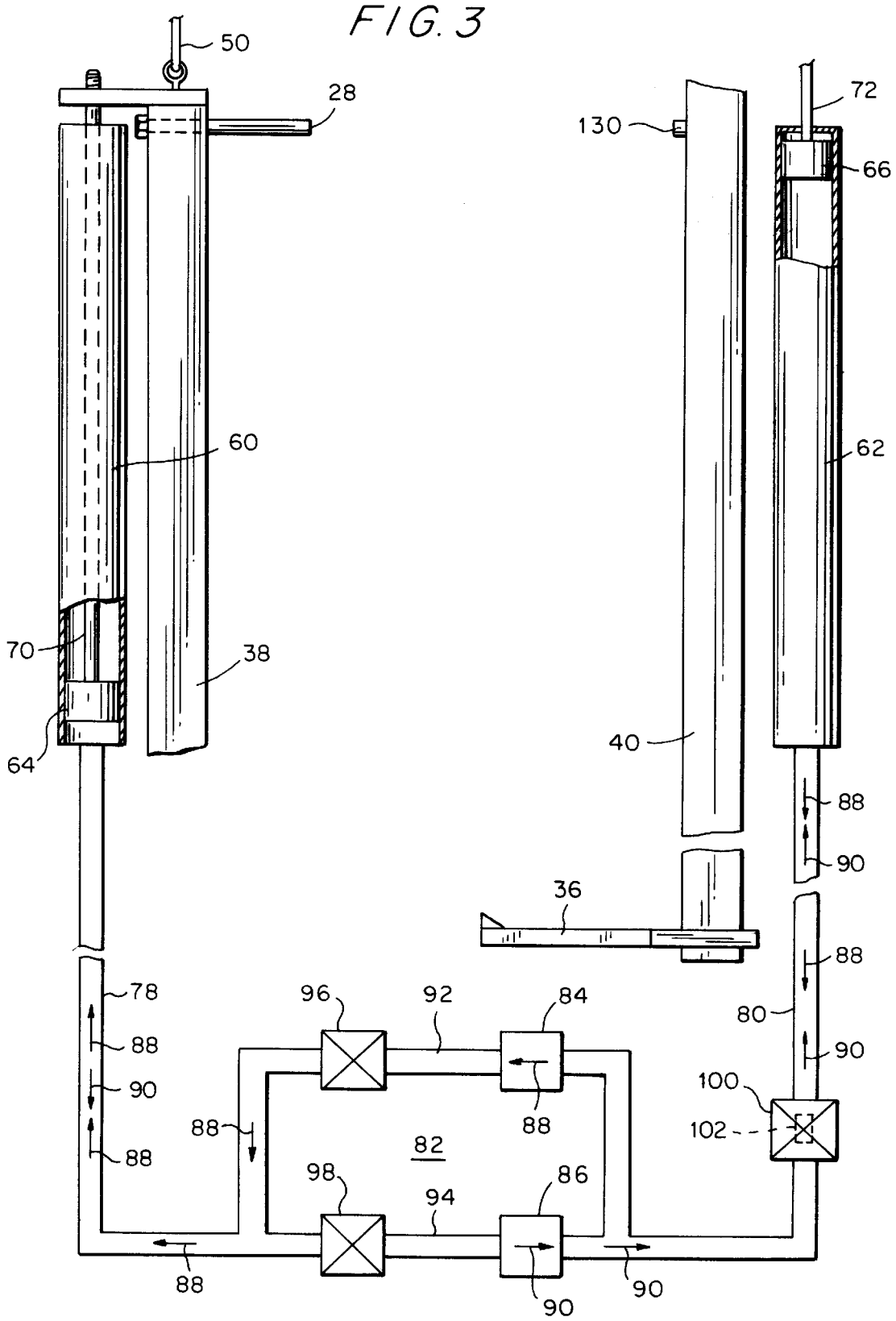
FIG. 3 is a diagrammatical view showing a hydraulic circuit for determining the length of the strokes in accordance with the length selected by the selector device of FIG. 4.

Referring now to FIG. 3, it is seen that the hydraulic lines 78 and 80 are joined through a second connection in the form of an alternate path hydraulic coupling 82. The alternate path hydraulic coupling 82 includes a first one-way check valve 84 and a second one-way check valve 86. The check valve 84 allows fluid to flow only in the direction of arrow 88, i.e., from the hydraulic cylinder 62 to the hydraulic cylinder 60. The second check valve 86 allows hydraulic fluid to flow only in the direction of the arrow 90 from the hydraulic cylinder 60 to the hydraulic cylinder 62. Check valve 84 is disposed and a hydraulic branch line 92 while the check valve 86 is in a second hydraulic branch line 94. The branch lines 92 and 94 have on-off solenoid valves 96 and 98, respectively, therein. When solenoid valve 96 is closed, hydraulic fluid can flow only through check valve 86 in the direction of arrow 90, and when the check valve 98 is closed, hydraulic fluid can only flow through the check valve 84 in the direction of the arrow 88. When the hydraulic fluid flow in the direction of the arrows 88, then the strut 40 can descend while the strut 38 rises, and when the hydraulic fluid can flow only in the direction of the arrows 90, then the strut 38 can only descend while the strut 40 can only rise. It is therefore seen that by closing the valve 96 while the valve 98 is open, the direction can be controlled in which the struts 38 and 40 move and in which their respective steps 34 and 36 and handgrips 28 and 30.

The speed at which one can operate the machine 10 is controlled by valve 100 which includes an orifice setting 102 which is selectively widened and narrowed to decrease and increase resistance to fluid flow in the direction of arrows 88 and 90.

Figure 4:
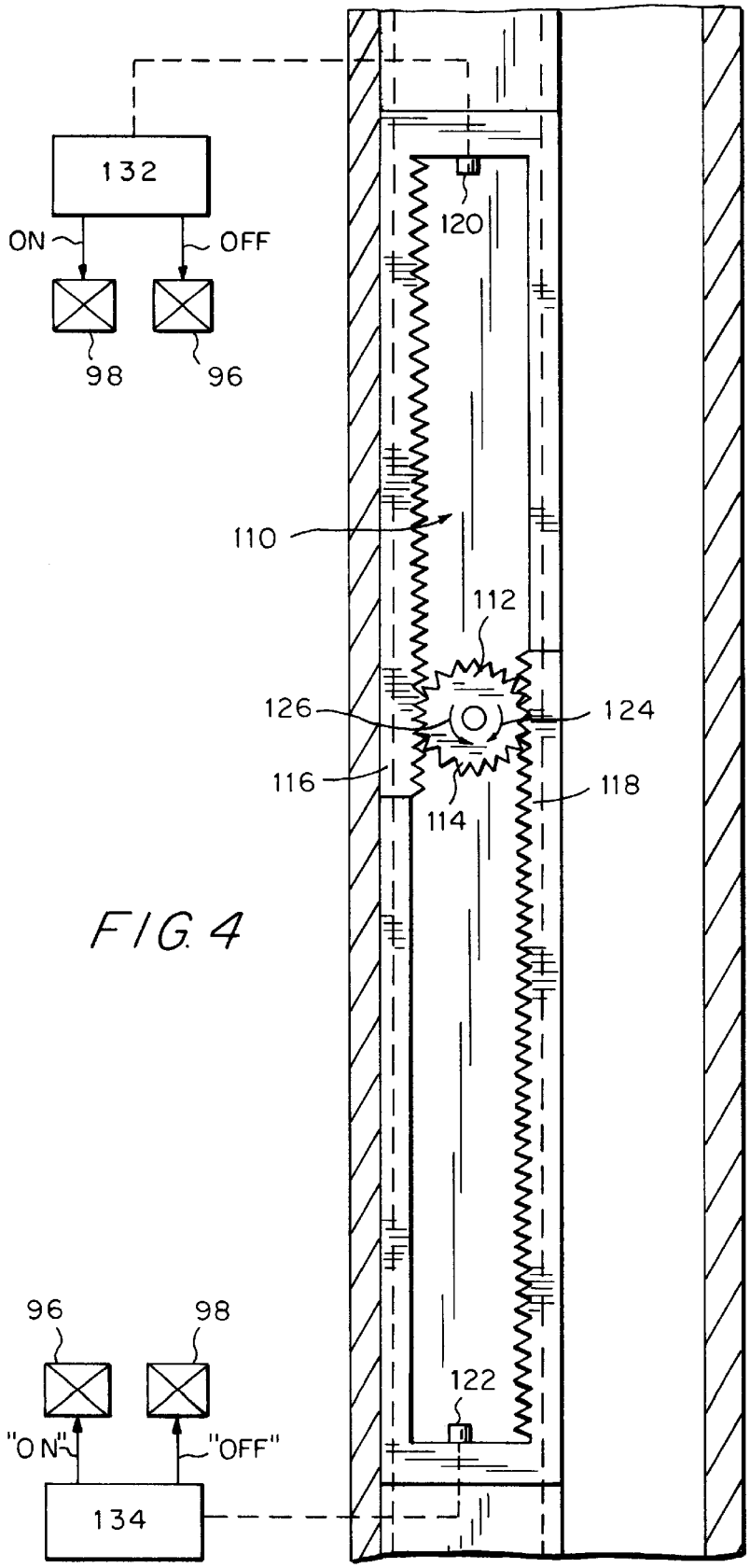
FIG. 4 is a side view illustrating an adjustable position sensor for selecting the length of exercise strokes.

Referring now to FIG. 4, there is shown a stroke selector 110 which determines the length of the stroke which the struts 38 and 40 will make before they are allowed to reverse direction. The selector of FIG. 4 includes a dial 112 which includes pinion 114. The pinion 114 meshes with racks 116 and 118. The racks 116 and 118 have switches, such as magnetic read switches, or the like 120, and 122 mounted thereon. The distance between the switches 120 and 122 is determined by rotating the dial 112 which, when rotated in the clockwise direction of arrow 124 moves the switches further apart, and when rotated in the counterclockwise direction 126, moves the switches closer together. Mounted on the strut 40 is a magnet 130. The switch 120 is connected to the solenoid valves 96 and 98 via a circuit 132 while the switch 122 is connected to the solenoid valves 96 and 98 via an electric circuit 134. When the magnet 130 on the strut 40 becomes into proximity with the switch 120, the circuit 132 opens the valve 96 and closes the valve 98 so that fluid can only flow in the direction of arrow 88. This allows the strut 40 to only descend while allowing the strut 38 to move only upwardly. When the strut 40 moves downwardly far enough, the magnet 130 comes into proximity with the switch 122 and this causes the circuit 134 to close the solenoid valve 96 and open the solenoid valve 98, thereby allowing fluid to only flow in the direction of arrow 90. When the fluid can only flow in the direction of arrow 90, then the strut 38 can only descend while the strut 40 can only rise. By moving the switches 120 and 122 closer together or further apart, the distance that the struts 38 and 40 move before being stopped and reversed is pre-selected by rotatably positioning the dial 112. Consequently, the person using the exercise machine 10 is required to cycle the machine through complete strokes instead of shortened strokes which tend to occur when the person exercising becomes tired. The circuits 132 and 134 are conventional flip-flop circuits which simply reverse application of electrical current to the solenoid valves 96 and 98 in a conventional way by cutting current to one solenoid valve and applying current to the other solenoid valve.

Figure 5:
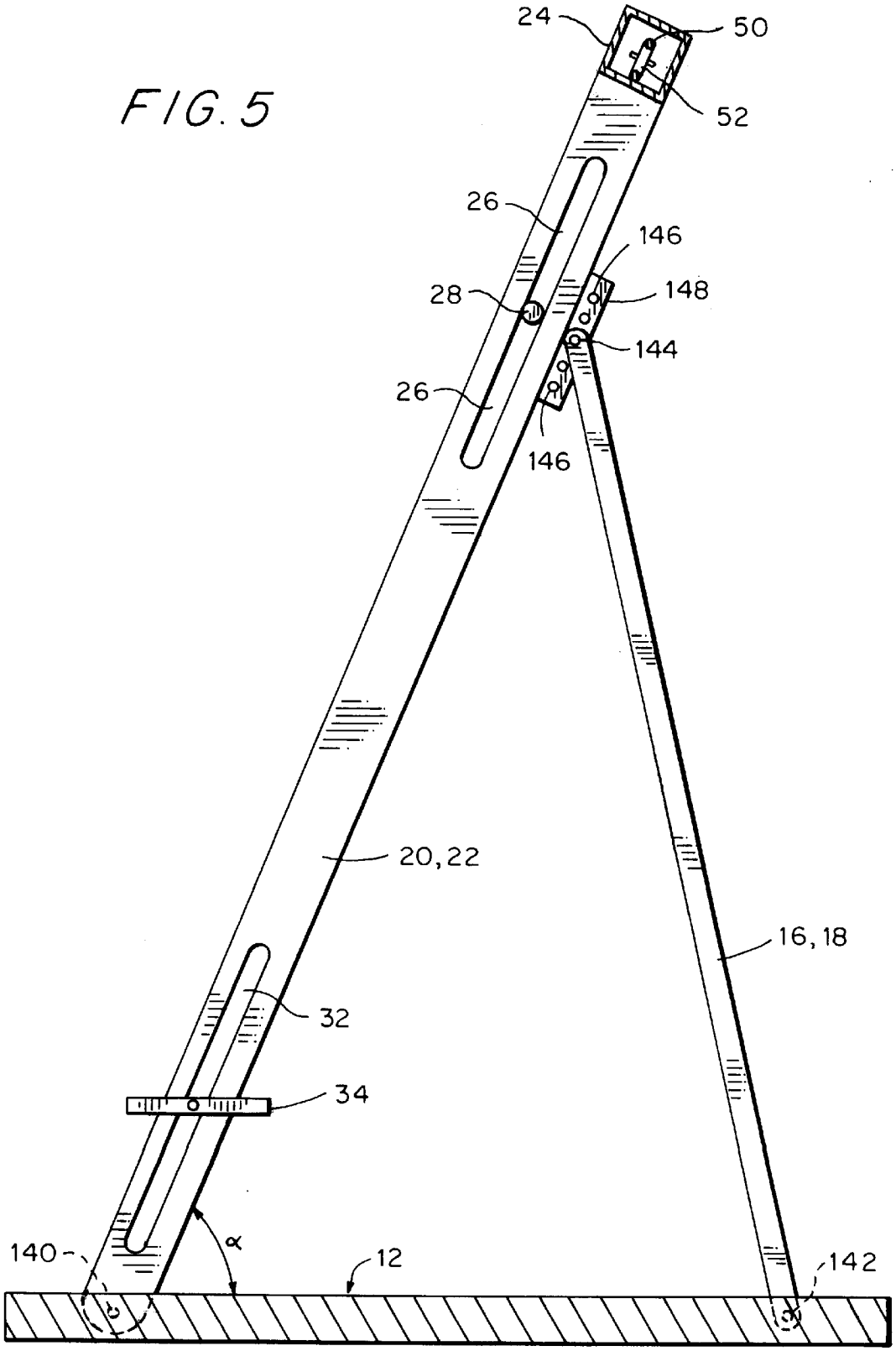
FIG. 5 is a side view of the stepper/climber exercise device of FIG. 1, taken on line 5—5 of FIG. 2.

Referring now to FIG. 5, it is seen that columns 20 and 22 are pivoted to the base 12 by internal pivots 140 so that the angle $\alpha$ can be set. The braces 16 and 18 are also pivoted to the base 12 by internal pivots 142 and are attached by pins 144 to holes 146 in brackets 148 fixed to each of the columns 20 and 22. In this way, the steepness of the step and climb exercise can be selected by varying the angle $\alpha$.

From the foregoing description, one skilled in the art can easily ascertain the essential characteristics of this invention, and without departing from the spirit and scope thereof, can make various changes and modifications of the invention to adapt it to various usages and conditions.

What is claimed:

1. An exercise device comprising:

a base;

a frame extending upwardly from the base;

a first strut restrained for longitudinal movement with respect to the frame, the first strut having a first foot pedal and a first handgrip positioned in spaced relation thereon;

a second strut restrained for longitudinal movement with respect to the frame, the second strut having a second pedal and a second handgrip positioned in spaced relation thereon;

a first connection between the first and second struts for pulling one strut in a rising stroke as the other strut is pushed down in a descending stroke;

a selector for pre-selecting a length for each of the stroke; and a second connection between the struts for controlling the lengths of the strokes by preventing the struts from changing from a rising stroke to a descending stroke and from a descending stroke to a rising stroke until the pre-selected length has been traversed by the struts whereby a person using the device is precluded from making strokes which are less than the length of the pre-selected strokes.

2. The exercise device of claim 1, wherein the second connection is a fluid circuit.

3. The exercise device of claim 2, wherein the fluid circuit includes alternate paths, each path including a check valve and an on-off valve, the check valves being oriented in opposite directions with respect to one another and being in series with the on-off valves wherein closing one check valve and opening the other check valve reverses the direction of flow of fluid in the circuit.

4. The exercise device of claim 3 further including sensors, the sensors being connected to the on-off valves for opening and closing the on-off valves upon sensing pre-selected positions of the struts determined by the selector for pre-selecting lengths of the strokes.

5. The exercise device of claim 4 further including an adjustment valve in the fluid circuit for selecting a flow rate for the fluid.

6. The exercise device of claim 5, wherein the first connection is flexible cable.

7. The exercise device of claim 6, wherein the fluid is hydraulic fluid.

8. The exercise device of claim 7, wherein the frame is comprised of a pair of horizontally spaced columns each of which supports a strut for sliding movement thereon and a cross beam for holding the columns spaced.

9. The exercise device of claim 8, wherein the columns and cross beams are hollow with the struts inside of the columns and the cable being trained from the tops of the struts through the columns and through the cross beam.

10. The exercise device of claim 1, wherein the frames are pivoted on the base and further including a brace mounted on the base and adjustably connected to the frame for determining the altitude of the frame.

11. The exercise device of claim 1, wherein the first connector is a cable connected to the tops of the struts and the second connector is a hydraulic circuit.

12. The exercise device of claim 1, wherein the frame is comprised of two columns each of which has a strut mounted therein.

13. A stepper/climber machine comprising:

a base;

a frame extending upwardly from the base;

a first foot pedal and a first handgrip positioned in spaced relation for movement on the frame through rising and descending strokes;

a second foot pedal and a second handgrip positioned in spaced relation for movement on the frame through rising and descending strokes;

a selector for pre-selecting a length for the strokes; and a connection for controlling the lengths of the strokes by preventing the foot pedals and handgrips from changing from a rising stroke to a descending stroke and from a descending stroke to a rising stroke until the pre-selected length has been traversed by the foot pedals and handgrips, whereby a person using the device is precluded from making strokes which are less than the length of the pre-selected strokes.

14. The stepper/climber machine of claim 13, wherein the connection means is a fluid circuit which includes alternate paths, each path including a check valve and an on-off valve, the check valves being oriented in opposite directions with respect to one another and being in series with the on-off valves, wherein closing one check valve and opening the other check valve reverses the direction of flow of fluid in the circuit.

15. The stepper/climber machine of claim 14 further including sensors, the sensors being connected to the on-off valves for opening and closing the on-off valves upon sensing pre-selected positions of the foot pedals and handgrips determined by the selector for pre-selecting lengths of the strokes.

16. The stepper/climber machine of claim 15 further including an adjustment valve in the fluid circuit for selecting a flow rate for the fluid.

* * * * *